United States Patent [19]

Brennecke et al.

[11] Patent Number: 4,638,398

[45] Date of Patent: Jan. 20, 1987

[54] APPARATUS FOR PRODUCING POSITIVE OR NEGATIVE IONS, ESPECIALLY FOR NEUTRALIZING CHARGED WORKPIECES

[75] Inventors: Hermann Brennecke, Darmstadt; Horst Liere, Eppertshausen; Michael Kiesel, Gross-Umstadt, all of Fed. Rep. of Germany

[73] Assignee: IRS Industrie Rationalisierungs-Systeme GmbH, Darmstadt-Eberstadt, Fed. Rep. of Germany

[21] Appl. No.: 717,443

[22] Filed: Mar. 29, 1985

[30] Foreign Application Priority Data

Apr. 4, 1984 [DE] Fed. Rep. of Germany ..... 3412563

[51] Int. Cl.[4] ..... B03C 3/66

[52] U.S. Cl. ..... 361/214; 361/229; 361/230; 361/235; 55/139; 323/903

[58] Field of Search ..... 361/212–214, 361/229, 230, 235; 315/200 R, 207 CD; 323/903; 55/105, 139

[56] References Cited

U.S. PATENT DOCUMENTS

| | | | |
|---|---|---|---|
| 3,369,152 | 2/1968 | Spengler | 361/230 |
| 4,042,971 | 8/1977 | Brennecke | 361/213 |
| 4,107,757 | 8/1978 | Masuda et al. | 361/235 |
| 4,232,355 | 11/1980 | Finger | 55/139 X |
| 4,333,123 | 6/1982 | Moulden | 361/229 X |
| 4,542,434 | 9/1985 | Gehlke et al. | 361/213 X |

FOREIGN PATENT DOCUMENTS

| | | | |
|---|---|---|---|
| 2536091 | 2/1977 | Fed. Rep. of Germany | 361/213 |
| 2822228 | 11/1979 | Fed. Rep. of Germany | 361/213 |
| 2902425 | 7/1980 | Fed. Rep. of Germany . | |
| 524112 | 7/1972 | Switzerland . | |

*Primary Examiner*—Michael L. Gellner
*Assistant Examiner*—D. Rutledge
*Attorney, Agent, or Firm*—Frishauf, Holtz, Goodman & Woodward

[57] ABSTRACT

A pulse generator operating at a frequency preferably somewhat higher than 100 Hz charges a capacitor through a diode and the trailing edge of the pulse switches-in a discharge circuit to discharge the capacitor through the low-voltage winding of a pulse transformer, the high-voltage winding of which charges, through another diode, the high-voltage insulated conductor of an ionizer that cooperates with a point-bearing electrode that is grounded. The high-voltage electrode discharges through a resistor between pulses and the diode assures that ions of the same polarity will be produced. The ionizer is suited for being located inside a spray gun of an electrostatic coating apparatus for charging the coating material particles with the ions without producing an electric field between the spray gun and the workpiece that would interfere with the coating of hollow places of the workpiece because of the so-called cage effect.

14 Claims, 2 Drawing Figures

APPARATUS FOR PRODUCING POSITIVE OR NEGATIVE IONS, ESPECIALLY FOR NEUTRALIZING CHARGED WORKPIECES

This invention concerns an apparatus for producing positive and/or negative ions by means of a high-voltage ionizer operating with an electrostatic induction discharge. The conductor of the apparatus which is at high voltage with respect to the environment is insulated, whereas the point discharge electrodes are grounded.

In electrostatic coating with liquid paint droplets or with powder or in electrostatic flocking to provide a napped coating, spraying apparatus with a protruding high-voltage electrode has heretofore been used. Such a spray apparatus produces an electric field, along the field lines of which the coating material flies through the intervening space to the workpiece by electrostatic forces.

This electric field, however, gives rise to a so-called cage effect in the coating of hollow bodies. The electric field lines or force going out of the spray gun run predominantly to the outside of the hollow body and accordingly the coating material flies only poorly into the hollows.

It is an object of the present invention to avoid this disadvantage.

Furthermore, in countless practical applications there is a need to maintain workpieces so far as possible in a state devoid of electrical charge, or to lead away a charge present on a workpiece so far as possible in order that the handling of the workpiece by factory or shop personnel should be trouble-free and especially without danger, so far as possible, of electrical shock. This need exists for example in electrostatic spray-coating whenever possible spark discharges of the workpiece could lead to explosive ignition of the powder and air mixture contained in the spraying cabinet. Furthermore, the quality of coating is impaired since then there is a change in the effective potential drop between spray apparatus and workpiece.

High-voltage ionizers of the general kind above mentioned which operate without contact are known from U.S. Pat. No. 3,369,152 and their use for electrostatic spray coating is known from U.S. Pat. No. 4,042,971. In each case the ionizers described are ionizers driven by alternating voltage. That feature leads to the result that the ions produced at the points of the grounded electrodes are, in alternation, positively and negatively charged. Many of the positive ions are neutralized by recombination with negative ions, and vice versa. The ion yield is thereby impaired and likewise the spatial extent of the ionization.

There are also known direct current ionizers by which ions all charged in the same polarity are produced. In these the point electrodes which are freely accessible from the outside must stand at high voltage, however, so that there are problems of protection against contact and risk of spark-over. These ionizers are quite out of the question for installations where there is risk of explosion.

SUMMARY OF THE INVENTION

It is an object of the present invention to provide a high-voltage ionizer of the general kind above described, namely one with grounded point electrodes, improved in such a way that the above described recombination of the ions produced does not take place. At the same time the ionizer should lend itself well to charging of coating material without also building up an electric field between ionizer and workpiece.

Briefly, the insulated conductor of the ionizer is connected, on one hand, through a diode over to a switchable discharge circuit of its capacitor which can be charged up in a predetermined polarity and, on the other hand, the said insulated conductor of the ionizer is grounded through a discharge resistance.

As a result of the capacitor which can be charged in a polarity that remains the same, the result is obtained that the discharge current in the ionizer continuously produces ions of the same polarity. In order that the discharge of the capacitor does not complete itself in the form of a more or less damped oscillation, the insulated conductor of the ionizer is connected through a diode to the discharge circuit of the capacitor. In that way, the expectable resonant circuit behavior of the ionizer together with the discharge circuit is excluded, which is to say that in the negative phase (back flow of the charge) no ions of opposite sign can be produced in the ionizer which would contribute to recombination. The stored charge can thus not flow back into the discharge circuit of the capacitor, but instead is led away by the discharge resistance of the insulated conductor in order to make possible a new charge current pulse for the ionizer.

The ionizer is exposed to a high value of charging up current and a low value of discharge current. The discharge accordingly takes place tenfold, hundredfold or thousandfold slower than the charging up, so that practically no ions of opposite polarity are produced. For each charging pulse a certain quantity of ions of the same polarity are produced in front of the insulated conductor and the succeeding ion boost of the same polarity drives these existing ion clouds off and thus away from the point electrodes. Accordingly, it is desirable to operate with a pulse frequency that is as high as possible, especially a frequency above 100 Hz. The charge pulse is then present only for very little time and therefore a resistor of low power rating is sufficient for the discharge resistance.

Because of the insulation of the high-voltage conductor the ionizer can be built into a spray apparatus without danger, so that the charging up of the coating material takes place in the interior of the spray apparatus and the heretofore necessary electrodes disposed at the spray gun exit are dispensed with. An electrical field over to the workpiece with the undesired cage effect accordingly cannot develop.

In a further elaboration of the invention it has been found particularly useful for the discharge circuit to contain one of the windings of a high-voltage transformer of which the other winding is interposed in the connecting conductor of the ionizer. The advantage then results that the discharge circuit can be operated at low voltage and only the conductor connected to the ionizer itself is at high voltage. The cabling of the installation is thereby made substantially more economical. A thyristor-controlled pulse generator provided with an oscillator is desirable for energizing the capacitor, which interrupts the connection of the capacitor to the generator and closes an interrupter in the discharge circuit after a predetermined desired voltage is reached at the capacitor. Furthermore, a monitoring and regulating unit can be connected to the pulse generator so that chance of short circuits or impermissibly high currents or voltages can be recognized at once and result in shutting down the apparatus.

BRIEF DESCRIPTION OF THE DRAWINGS

The invention is further described by way of illustrative example with reference to the annexed drawings, in which.

DESCRIPTION OF THE ILLUSTRATED EMBODIMENT

Figure 1:
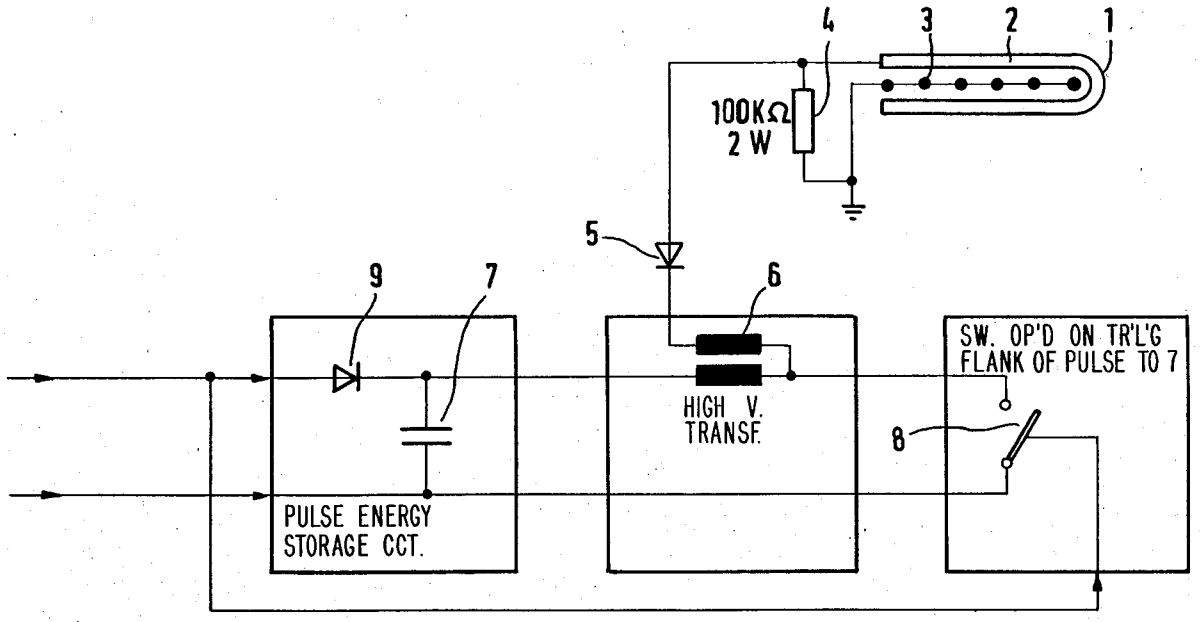
FIG. 1 is a block circuit diagram of the discharge circuit and the ionizer of an apparatus according to the invention.

The ionizer 1 consists of a conductor 2 which is insulated against the environment and surrounds a row of upwardly projecting point electrodes 3. The conductor 2 is connected to a high voltage of between 50 and 150 kV, while the point electrodes 3 are grounded. It is of course possible to provide the construction of the ionizer in some other way going back to other kinds of construction as shown for example in German Patent No. 25 36 091.

The conductor 2 is on the one hand connected through a discharge resistance 4 to ground and on the other hand connected over a diode 5 and a high-voltage transformer 6 to the discharge circuit of a capacitor 7. The high-voltage winding of the transformer 6 is in series with the already mentioned connection of the conductor 2 and the low-voltage winding is in series with the discharge circuit. An interrupter switch 8 is also built into the discharge circuit. It is operated in response to the downward or trailing flank of the discharge pulse of the capacitor 7.

Since the capacitor 7 is in general connected to alternating voltage, a diode 9 is interposed in circuit in front of it. It assures that the charging of the capacitor takes place always at constant polarity and the ionizer 1 accordingly produces only ions of the same polarity.

It is within the scope of the invention to integrate the discharge resistance 4, the diode 5 and in certain cases also the transformer 6 in the casing of the ionizer 1.

Figure 2:
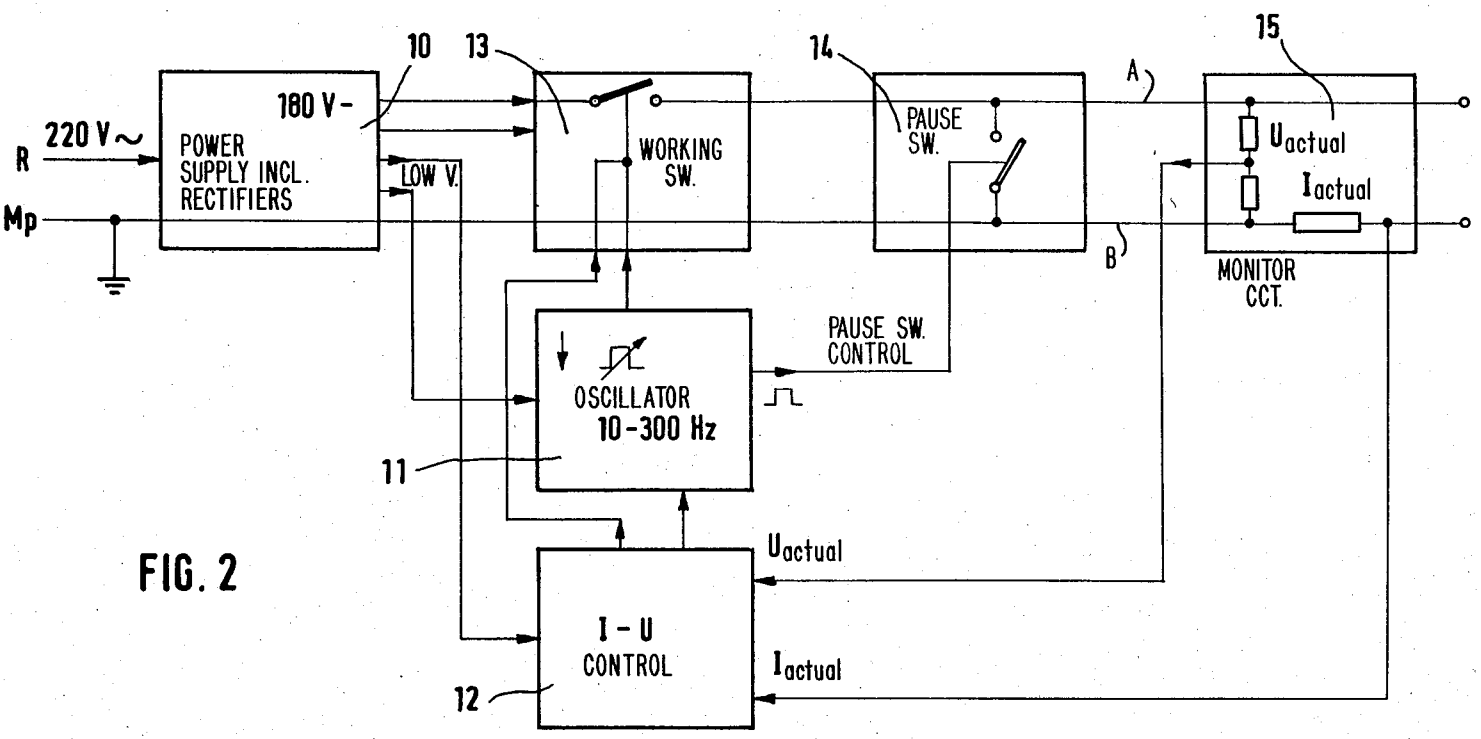
FIG. 2 is a block circuit diagram of the pulse generator.

The circuit block diagram shown in FIG. 2 shows how the pulse generator for energizing the capacitor 7 is constituted. The circuit comprises a transformer 10 equipped with a rectifier not shown, an oscillator 11, a control unit 12 for controlling current and voltage, an work switching circuit 13, a pause control switch 14 and a current and voltage measuring device 15.

The oscillator 11 that operates at a frequency from 10 to 300 Hz, preferably at a frequency above 100 Hz, closes the switch of the work switching circuit 13. The capacitor is thereby charged. As soon as the measuring circuit 15 determines that the desired voltage has been reached at the capacitor, the current supply to the switching circuit 13 is interrupted, and the pause switch 14 is closed. The voltage between the conductors A and B then falls to zero and this voltage drop in front of the diode 9 controls the switch 8, (FIG. 1) which then closes when the voltage in front of the diode 9 lies near zero. The capacitor can then discharge, as a result of which the discharge current in the high-voltage transformer 6 and thereby in the conductor 2 of the ionizer 1 produces the desired high-voltage pulse. When the pulse voltage has receded to a prescribed value, the switch 8 and the pause switch 14 are opened by known electronic means that need not be further described, the working switch 13 is closed, and the process then repeats itself.

Of course, the current supply of the circuit shown in FIG. 1 can also be arranged in some other way.

If it is necessary to expose the workpieces to be discharged both with positive and with negative ions, it is desirable to utilize two correspondingly polarized ionizers, at a distance from each other, however, such that their ion clouds will not intersect each other but will meet only in the region of the workpiece.

If the apparatus of the invention, instead of being used for discharging workpieces, should be used for charging with the same polarity of charge, particularly the charging of coating material of electrostatic coating installations, the point electrodes 3 in the flow channel of the coating material are so disposed that the coating material is positively or negatively charged in passing the ionizer. The coating material in the form of powder or droplets then flies through the air driven by electrostatic attraction forces over to the workpiece and may in its path be supported by compressed air. Since the point electrodes are disposed inside the spray gun and thus can build up no electric field with the workpiece to be coated, the operation cannot get involved with the occurrence of the above-mentioned cage effect. It makes no difference, then, whether external surfaces or hollows are to be coated.

Because the electrodes at high voltage are insulated there is also no danger that sparking-over, explosions or the like will take place within the spray apparatus.

The invention also has the advantage that the operation no longer can involved mutual neutralization of oppositely charged coating particles. The elimination of neutralized coating material that no longer reaches the workpiece but merely loads the surrounding air is thereby substantially reduced.

As already mentioned in several respects, variations and modifications are possible within the inventive concept.

We claim:

1. Apparatus for producing ions of a preselected polarity including a grounded electrode having electric-field accentuating points and a high-voltage electrode near, but spaced from, said grounded electrode and insulated by solid insulation from its surroundings but substantially uninsulated from said grounded electrode except by intervening air space, and further comprising:

a capacitor (7) having a substantially grounded terminal and an ungrounded terminal, for intermittently storing electric energy;

means for intermittently charging said capacitor and thereby intermittently accumulating a voltage of a predetermined polarity at said ungrounded terminal of said capacitor;

circuit means for intermittently discharging said capacitor at instants when it has reached a predetermined level of charge and simultaneously providing a high-voltage pulse for said high-voltage electrode;

a connection between said high-voltage electrode and said discharging circuit means for applying, to said high-voltage electrode, high voltage pulses provided by said discharging circuit means, said connection including a diode (5) interposed between said high-voltage electrode and said discharging means for preventing a return flow of current from said high-voltage electrode and assuring that ions produced are predominantly of the same polarity, and an electrical resistance (4) connected between said high-voltage electrode and ground for substantially discharging said high-voltage electrode during intervals between said high-voltage pulses said electrical resistance being of a resistance magnitude permitting substantial discharge of said high-voltage electrode during each one of said intervals between said high-voltage pulses.

2. Apparatus according to claim 1 wherein capacitance in parallel to said electrical resistance (4) is provided entirely by capacitance to ground of said high-voltage electrode and of the portion of said connection extending between said high-voltage electrode and said diode (5) and wherein said electrical resistance (4) has a value sufficiently high to result in a rate of discharge of said high-voltage electrode which is at least ten times slower than the rate of charge of said high-voltage electrode.

3. Apparatus according to claim 2, wherein said circuit means for intermitently discharging said capacitor is constituted so as to operate at a frequency greater than 100 Hz.

4. Apparatus according to claim 2, wherein said circuit means for intermittently discharging said capacitor includes a transformer (6) having a low-voltage winding and a high-voltage winding and means for intermittently grounding said ungrounded terminal of said capacitor to said low-voltage winding, said low-voltage winding being interposed between said intermittent grounding means and said ungrounded terminal and said high-voltage winding being connected between said intermittent grounding means and said diode (5).

5. Apparatus according to claim 2, wherein said means for intermittently charging said capacitor include a pulse generator (10–15) including an oscillator (11) and in which means are provided for interrupting the charging-up of said capacitor after the voltage across said capacitor has reached a predetermined value.

6. Apparatus according to claim 5, wherein said pulse genenerator is constituted for delivering pulses of electric voltage of a predetermined polarity with respect to ground potential to said capacitor, and in which means including a diode (9) are provided for preventing discharge of said capacitor through connections between said pulse generator and said capacitor.

7. Apparatus according to claim 2, wherein two complete apparatus combinations according to claim 2 are provided utilizing opposite predetermined polarities of the ions respectively predominantly produced thereby, in which the respective high-voltage electrodes and the grounded electrodes respectively associated with said high-voltage electrodes are so located that when a workpiece is provided in a predetermined location for being stripped of charge by ions produced by said respective electrode pairs, the charge stripping fields of the respective ion outputs of said electrode overlap only in the neighborhood of said workpiece.

8. Apparatus according to claim 1, wherein said circuit means intermittently discharging said capacitor is constituted so as to operate at a frequency greater than 100 Hz.

9. Apparatus according to claim 1, wherein said circuit means for intermittently discharging said capacitor includes a transformer (6) having a low-voltage winding and a high-voltage winding and means for intermittently grounding said ungrounded terminal of said capacitor to said low-voltage winding, said low-voltage winding being interposed between said intermittent grounding means and said ungrounded terminal and said high-voltage winding being connected between said intermittent grounding means and said diode (5).

10. Apparatus according to claim 1, wherein said means for intermittently charging said capacitor include a pulse generator (10–15) including an oscillator (11) and in which means are provided for interrupting the charging-up of said capacitor after the voltage across said capacitor has reached a predetermined value.

11. Apparatus according to claim 10, wherein said pulse generator is constituted for delivering pulses of electric voltage of a predetermined polarity with respect to ground potential to said capacitor, and in which means including a diode (9) are provided for preventing discharge of said capacitor through connections between said pulse generator and said capacitor.

12. Apparatus according to claim 1, wherein two complete apparatus combinations according to claim 1 are provided utilizing opposite predetermined polarities of the ions respectively predominantly produced thereby, in which the respective highvoltage electrodes and the grounded electrodes respectively associated with said high-voltage electrodes are so located that when a workpiece is provided in a predetermined location for being stripped of charge by ions produced by said respective electrode pairs, the charge stripping fields of the respective ion outputs of said electrode pairs overlap only in the neighborhood of said workpiece.

13. Apparatus according to claim 1, wherein at least said high-voltage electrode and said grounded electrode of said apparatus are mounted on the interior of an electrostatic spraying gun structure.

14. Apparatus according to claim 1, wherein at least said high-voltage electrode and said grounded electrode of said apparatus are mounted on the interior of an electrostatic spraying gun structure.

* * * * *